US005407388A

United States Patent [19]

Comfort et al.

[11] Patent Number: 5,407,388

[45] Date of Patent: Apr. 18, 1995

[54] COIN STORAGE DEVICE

[75] Inventors: John J. Comfort, Hampshire, England; Michael E. Newton, Surby, Great Britain

[73] Assignee: Mars Incorporated, McLean, Va.

[21] Appl. No.: 211,380

[22] PCT Filed: Sep. 18, 1992

[86] PCT No.: PCT/GB92/01727

§ 371 Date: May 18, 1994

§ 102(e) Date: May 18, 1994

[87] PCT Pub. No.: WO91/06073

PCT Pub. Date: May 2, 1991

[30] Foreign Application Priority Data

Oct. 4, 1991 [GB] United Kingdom ..... 9121299

[51] Int. Cl.[6] ..... G07D 1/00

[52] U.S. Cl. ..... 453/49

[58] Field of Search ..... 453/49, 57; 221/75

[56] References Cited

U.S. PATENT DOCUMENTS

| | | | |
|---|---|---|---|
| 1,625,979 | 4/1927 | Brinkerhoff | 453/49 |
| 3,779,257 | 12/1973 | Wenger | 453/49 |
| 3,948,377 | 4/1976 | Hayashi et al. . | |
| 4,167,949 | 9/1979 | Hashimoto et al. . | |
| 4,360,034 | 11/1982 | Davila et al. . | |
| 4,527,577 | 7/1985 | Miller et al. | 453/57 X |
| 4,559,958 | 12/1985 | Wingerter . | |
| 4,836,825 | 6/1989 | Smeets et al. | 453/49 |

FOREIGN PATENT DOCUMENTS

| | | | |
|---|---|---|---|
| 0000010 | 12/1978 | European Pat. Off. . | |
| 2135654 | 12/1972 | France . | |
| 2293749 | 7/1976 | France . | |
| 1957092 | 3/1971 | Germany . | |
| 3045733 | 7/1982 | Germany | 453/49 |
| 3307438 | 9/1984 | Germany . | |
| 3433342 | 5/1985 | Germany . | |
| 67376/A86 | 5/1986 | Italy . | |
| 442406 | 2/1936 | United Kingdom . | |
| 992911 | 5/1965 | United Kingdom . | |
| 1456532 | 11/1976 | United Kingdom . | |
| 2047936 | 12/1980 | United Kingdom . | |
| 2070307 | 9/1981 | United Kingdom . | |
| 2088108 | 6/1982 | United Kingdom . | |
| 2097165 | 10/1982 | United Kingdom . | |
| 2124814 | 2/1984 | United Kingdom . | |
| 2135094 | 8/1984 | United Kingdom . | |
| 2201823 | 9/1988 | United Kingdom . | |
| 2219681 | 12/1989 | United Kingdom . | |
| 80/01117 | 5/1980 | WIPO . | |
| 91/06073 | 5/1991 | WIPO . | |

*Primary Examiner*—F. J. Bartuska

*Attorney, Agent, or Firm*—Davis Hoxie Faithfull & Hapgood

[57] ABSTRACT

A coin store comprising a helical structure for receiving coins and storing them between turns so that they can be moved in either of two directions by rotation of the structure, drive for rotating the structure in either of two corresponding directions, and an access enabling gate which is operable to selectively enable a cash access point of the store in response to operation of the drive.

12 Claims, 3 Drawing Sheets

COIN STORAGE DEVICE

FIELD OF THE INVENTION

This invention relates to coin stores, and is particularly but not exclusively concerned with coin escrows, which are stores used, e.g. in payphones, for temporarily retaining coins before dispensing them so that they can either be retained in a cash box or refunded to a user.

BACKGROUND OF THE INVENTION

The applicants disclosed and claimed in their International Patent Application published under No. WO 91/06073 (which is incorporated herein by reference, in its entirety) coin stores of a type involving a helical structure which was rotated to dispense coins from various exits, and which had advantages of compactness and low power consumption among others. A corresponding U.S. application issued on Oct. 18, 1994, bearing U.S. Pat. No. 5,356,333.

In those coin stores, a motor was required to rotate the helical structure. Additionally, in the embodiment of FIGS. 1 to 8 additional actuators were required to position the tubes 42 and 44 so as to select coin exits and in the embodiment of FIGS. 9 and 10, where the helical structure was integral with a single outer tube, one additional actuator was required to selectively inhibit and enable coin exits 20 and 24.

SUMMARY OF THE INVENTION

An object of the invention is to provide a coin store which retains many of the advantages of those prior coin stores but which is simpler in construction and lower in cost and which may also consume less power.

In accordance with the invention there is provided a coin store comprising a helical structure for receiving coins and storing them between turns so that they can be moved in either of two directions by rotation of the structure, and drive means for rotating the structure in either of two corresponding directions, characterised by means which is operable to selectively enable a coin access point of the store in response to operation of said drive means.

Thus, the drive means which rotates the helical structure serves also to selectively enable a coin access point, so that no additional actuators are required for the latter purpose.

Preferably, said access point is an exit point for stored coins, and said means is operable to enable that exit point in response to operation of the drive means in the direction for moving coins towards said exit point, so that when coins reach that point they can exit at it.

In a preferred embodiment which will be described, that exit point is inhibited when the helical structure is rotated in the opposite direction, but this is not essential because during rotation in that direction coins are moving away from that exit point so it does not matter whether it is open or closed.

Preferably there is a further coin exit point, whereby coins stored between the two exit points can be selectively moved towards, and exit at, either them depending upon the direction of operation of said drive means.

Preferably, the first-mentioned exit point leads to a coin refund path and the further coin exit point leads to a cash box.

As fully explained in the above-mentioned published application, coins which have been inserted by a user are temporarily stored in the coin store and dispensed from there to the cash box to the extent that is necessary to pay for goods or a service (such a telephone call) and any surplus coins remaining after that has been done are dispensed on the refund path and hence returned to the user.

In the described embodiment of the present invention, dispensing to the cash box is achieved by rotating the helical structure in one direction, and dispensing to the refund path is done by rotating the helical structure in the opposite direction, which will result in the refund exit automatically being enabled in response to the operation of the drive means, so the coins can exit from it as they arrive there in turn.

The coin store further has an entry point for the entry of coins to between turns of the helical structure. Normally, the coins arriving at the entry point will have been validated by a coin validator, and routed to the entry point, as more fully described in the above-mentioned published application.

Preferably the entry point is at the same location along the helical structure as the selectively enabled exit point. When coins are being entered into the store, it will be in a stationary, coin entry, condition in which the selectively enabled exit point is inhibited, so that the entering coin will not exit from the store, but will remain in it, so that the helical structure can be rotated to move the coin to a storage position along the helical structure.

In the preferred embodiment the means operable to selectively enable said exit point includes a gate which is moveable between respective positions in which it blocks an opening at said exit point to inhibit it, and uncovers said opening to enable the exit point.

DETAILED DESCRIPTION

A particular mechanical arrangement for operating such a gate is described below as part of the preferred embodiment, but it will be appreciated that other mechanical arrangements are within the abilities of a man skilled in the art, which would be capable of ensuring closure of the gate in response to rotation in one direction and opening it in response to rotation in the other direction.

BRIEF DESCRIPTION OF THE DRAWINGS

In order that the invention may be more clearly understood, a preferred embodiment thereof will now be described, by way of example, with reference to the accompanying diagrammatic drawings in which

Referring first to FIGS. 1 and 2, the coin store comprises a plastics cylinder 10 which is hollow and has on its inner surface an integrally-formed helical structure like that shown more fully in FIG. 9 of the above-mentioned published application. In FIG. 2 the first turn 12 of that helical structure can be seen.

Figure 1:
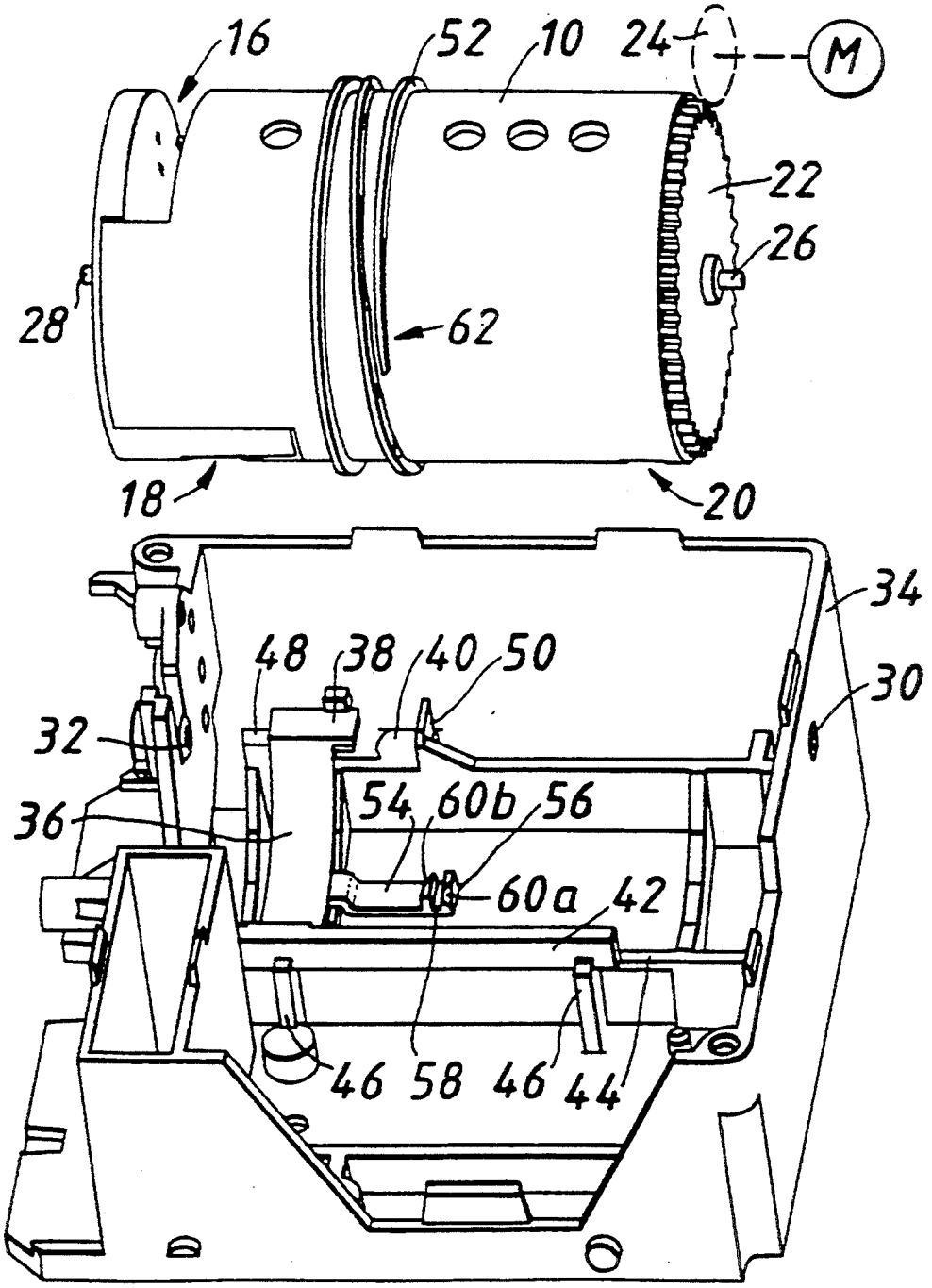
FIG. 1 is a partially-exploded view of the construction of a coin store in accordance with the invention.

Between the first turn 12 and the closed end 14 of the cylinder, there is a coin space into which leads a circumferential coin entry opening 16 and out of which leads a circumferential coin exit opening 18 which in use will lead to a refund path. Several turns of the helical structure are contained within the cylinder 10 and between the last two turns there is a further circumferential exit opening 20.

At one end, cylinder 10 is provided with a gear 22 which meshes with a further gear 24 driven, for example, by a stepping motor M as shown schematically in FIG. 1. The motor M can drive in either direction.

Referring to FIG. 1, cylinder 10 is provided with stub axles 26 and 28 at respective ends, which fit into bearings 30 and 32 in a support frame generally indicated at 34. For present purposes, the details of the construction of the support frame are unimportant.

When the cylinder 10, in the orientation shown in FIG. 1, is mounted in the support frame 34 its exit 18 lies closely above and is covered by a curved gate 36. Gate 36 is provided on one side with a bearing pad 38 which is slidable on a flat bearing surface 40 of the frame 34 and on the other side with an elongated bearing bar 42 which is slidable on an elongated bearing surface 44 forming part of the frame 34 and which runs between pairs of guides 46 which maintain correct orientation of the gate 36. In FIG. 1, gate 36 is shown in a leftward position where it covers opening 18 and where it is in contact with a left-hand stop 48. It can be moved to the right, as will be explained, until it contacts another stop 50, in which position it leaves the exit 18 open.

Figure 3:
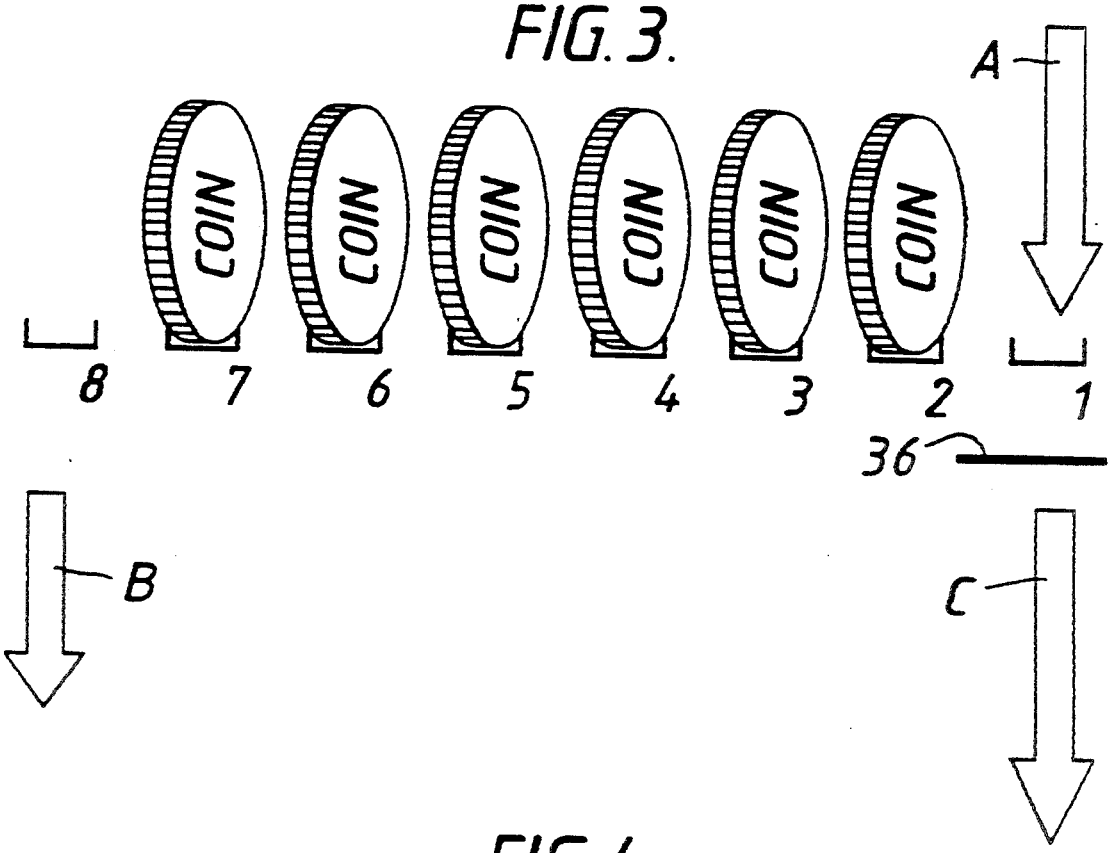
FIG. 3 shows coins at coin store locations and entry and exit points, in a similar manner to FIG. 7 and 8 of the above-mentioned published application.

When the cylinder 10 is in its rest position as illustrated in FIG. 1, gate 36 is to the left, closing exit 18, and this situation is illustrated in simple fashion in FIG. 3. Coins are inserted one-by-one through entry 16 into location 1 of the helical structure as indicated by arrow A in FIG. 3. Each coin is initially retained in location 1 because gate 36 is closed. Control means, more fully referred to in the above-mentioned published application, then cause motor M to be driven in a direction such that the coin is moved axially along the helical structure to location 2, thus leaving location 1 empty and ready to receive a further coin. In the arrangement illustrated, a maximum of six coins can be stored, these being at locations 7, 6, 5, 4, 3 and 2 of FIG. 3, in the order in which they were inserted.

When, for example, during or at the end of a telephone call, it is desired to dispense coins to the cash box to pay for time that has been, or is being, used, motor M is driven in a direction to progress the coins leftwards and as each coin reaches location 8 it falls through opening 20 into the cash box as indicated by arrow B in FIG. 3. Thus, coins go to the cash box on a first-in-first-out basis. At the end of the transaction, all coins not required to pay for the transaction are returned to the user by operating motor M in the opposite direction so that the coins progress to the right in FIG. 3. This automatically moves gate 36 to its open position so that as each coin reaches location 1 it drops through opening 18, uncovered by gate 36, onto the refund path as indicated by arrow C.

Figure 2:
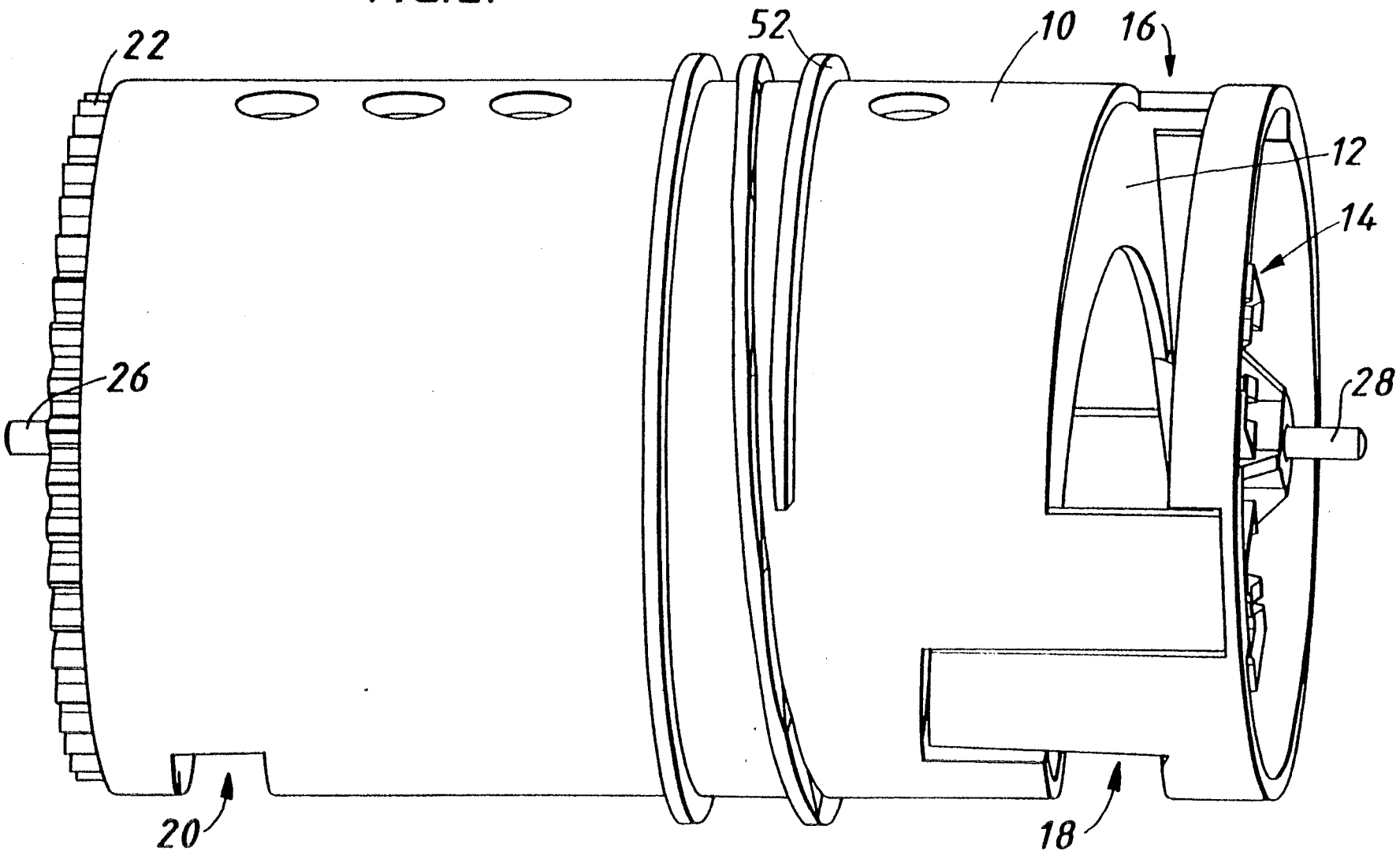
FIG. 2 shows the cylinder of the coin store of FIG. 1, from the opposite side to that shown in FIG. 1.

The manner in which gate 36 is operated will now be described with reference to FIGS. 1 to 3.

Figure 4:
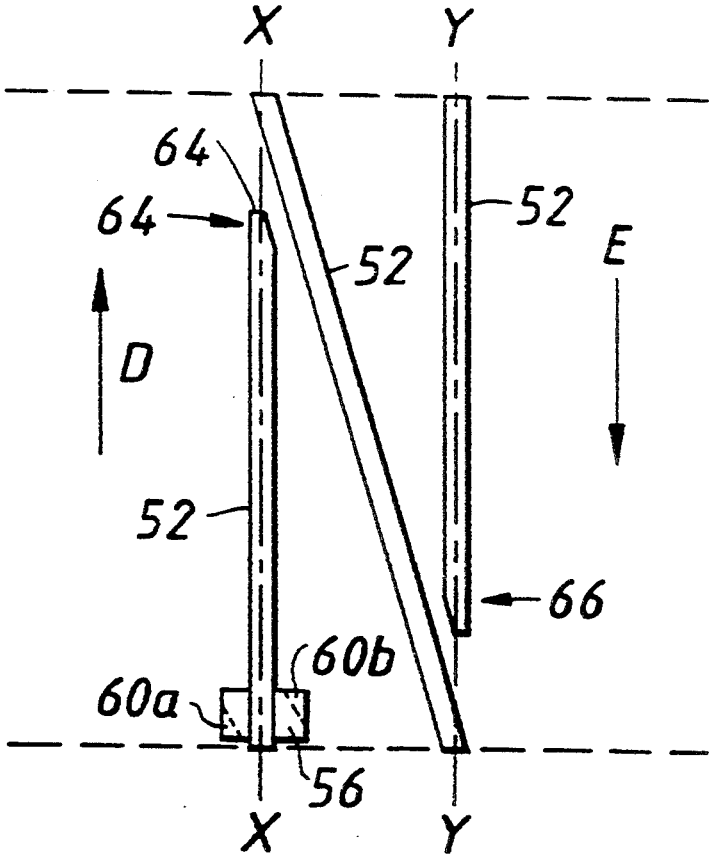
FIG. 4 shows, in a flattened version, a helical camming means, the broken horizontal lines corresponding approximately to the lower edge of the cylinder in FIGS. 1 and 2.

Camming means in the form of a rib 52 is integral with, and extends approximately two and a half turns around, the outside of cylinder 10. The middle section of rib 52, shown at an angle in FIG. 4, is helical but its end sections lie in planes substantially perpendicular to the axis of cylinder 10. Gate 36 has formed integrally therewith, in plastics material, a springy arm 54 at the end of which is carried a cam follower portion 56 having a central groove 58 which engages over rib 52. Cam follower portion 56 is also provided with small bevelled surfaces **60*a* and 60*b***.

To consider how cam follower portion 56 cooperates with rib 52, it is simplest, referring to FIG. 4, to consider cam follower portion 56 as moving linearly in the direction of arrow D when cylinder 10 rotates in one direction, and moving linearly in the opposite direction E when it rotates in the opposite direction.

When cam follower portion 56 is on an end section of rib 52, as shown in FIG. 4, then gate 36 is either in its open or in its closed position. If, from there, cylinder 10 is rotated in a direction corresponding to movement of cam follower portion 56 in direction D, then when portion 56 reaches the region 62 where the rib sections are close to each other the bevelled surface **60*b* contacts the angled section of rib 52 and cam follower portion 56 rides over this section of the rib against the resilience of the spring arm 54, and then settles back down onto the rib with groove 58 once again in engagement with the rib. In effect, the cam follower portion 56 rides round and round the cylinder 10 staying on the line (or in three dimensions in the plane) represented by chain-dotted line X—X in FIG. 4**.

If, on the other hand, the cylinder 10 is rotated in the opposite direction, then in relation to FIG. 4 cam follower portion 56 will travel in the direction of arrow E. It will then approach the region 62 in the opposite direction from before, and the small chamfered surface **60*a* will contact the end 64 of rib 52, thus encouraging the cam follower section 56 to follow the rib and ride along its helical central section for one complete rotation of cylinder 10, until the cam follower portion 56 reaches the region 66, at which time it rides directly onto the other linear end section of rib 52. Continued rotation of cylinder 10 then results in cam follower portion 56 riding around on the right-hand linear section of rib 52 on the line Y shown in chain dotted lines in FIG. 4, jumping the gap between the rib portions in the region 66, in the manner previously explained in relation to the gap in region 62**.

Thus, starting with the store in the condition illustrated by FIG. 1, with gate 36 closed, and the groove 58 in engagement with the left-hand (as viewed in FIG. 2) section of rib 52, operation of motor M in such a direction as to move coins from location 1 of the store into the higher-numbered locations of the store and, eventually, to location 8 from where the coin exits to the cash box, results in the gate 36 remaining closed so that when such rotation stops with the cylinder 10 in its rest position gate 36 will be closing exit 18 ready for location 1 of the cylinder to receive a newly-entered coin.

However, if the motor M is operated to rotate cylinder 10 in the opposite direction, so as to move coins in the store towards the refund exit 18, then within one full rotation of the cylinder gate 36 will have moved to the open position so as to allow the coin from location 2, which will be moved to location 1 by that same single rotation, to drop out through exit 18, followed by any coins originally in locations 3, 4 and so forth as rotation continues. A single rotation of the cylinder 10 back in the first direction resets the gate 36 to the closed position to make the store ready for receiving coins for the next transaction.

It would be possible to actually use gate 36 as an accept/reject gate controlled for that purpose by the outputs of a coin validator driving motor M by one revolution to reject the coin on the refund path, or driving it the other way to store an acceptable coin, though this would be slow relative to currently used accept/reject arrangements.

We claim:

1. A coin store comprising a helical structure for receiving coins and storing them between turns so that they can be moved in either of two directions by rotation of the structure, drive means for rotating the structure in either of two corresponding directions, and access enabling means which is operable to selectively enable a coin access point of the store in response to operation of said drive means in only one of the two directions.

2. A coin store as claimed in claim 1 wherein said access point is an exit point for stored coins, and said one direction is the direction for moving coins towards said exit point.

3. A coin store as claimed in claim 2 comprising a further coin exit point, whereby coins stored between the two exit points can be selectively moved towards, and exit at, either of the two exits depending upon the direction of operation of said drive means.

4. A coin store as claimed in claim 3 wherein the first-mentioned exit point leads to a coin refund path and the further coin exit point leads to a cash box.

5. A coin store as claimed in claim 1 further comprising an entry point for entry of coins to between turns of said structure, the access point forming an exit point for stored coins.

6. A coin store as claimed in claim 4 wherein said entry point is at the same location along the helical structure as the access point.

7. A coin store as claimed in claim 4 wherein the helical structure has a stationary, coin entry condition in which said access point is inhibited.

8. A coin store as claimed in claim 1, wherein said access enabling means is operable to inhibit said access point in response to operation of said drive means in the other direction.

9. A coin store as claimed in claim 1 wherein said access enabling means includes a gate movable between respective positions in which it blocks an opening at said access point to inhibit it, and uncovers said opening to enable the access point.

10. A coin store as claimed in claim 9 wherein the gate moves in the axial direction of said helical structure.

11. A coin store as claimed in claim 9 wherein said access enabling means includes camming means which rotates with said helical structure and which engages cam follower means linked to said gate, so as to move the gate in opposite directions in response to the helical structure rotating in opposite directions.

12. A coin store as claimed in claim 11 wherein the camming means and cam follower means are adapted to cause only limited gate movement irrespective of the amount of rotation.

* * * * *